US007149438B2

(12) United States Patent
Sasaki

(10) Patent No.: US 7,149,438 B2
(45) Date of Patent: Dec. 12, 2006

(54) CONSUMABLE-ARTICLE DETECTING APPARATUS, METHOD AND PROGRAM, AND IMAGE FORMING APPARATUS

(75) Inventor: Sachio Sasaki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/320,736

(22) Filed: Dec. 30, 2005

(65) Prior Publication Data

US 2006/0104648 A1 May 18, 2006

Related U.S. Application Data

(63) Continuation of application No. PCT/JP03/09136, filed on Jul. 17, 2003.

(51) Int. Cl.
*G03G 15/00* (2006.01)
*G03G 15/08* (2006.01)

(52) U.S. Cl. ..... 399/27; 399/12

(58) Field of Classification Search ..... 399/27, 399/29, 30, 12, 24, 9

See application file for complete search history.

(56) References Cited

U.S. PATENT DOCUMENTS

| | | | | |
|---|---|---|---|---|
| 4,963,939 | A * | 10/1990 | Kurando et al. | 399/12 |
| 2001/0051051 | A1* | 12/2001 | Matsumoto | 399/27 X |
| 2004/0114944 | A1* | 6/2004 | Urabe | 399/12 |

FOREIGN PATENT DOCUMENTS

| | | |
|---|---|---|
| JP | 63-98681 | 4/1988 |
| JP | 10-198255 | 7/1998 |
| JP | 11-52724 | 2/1999 |
| JP | 2001-255724 | 9/2001 |

* cited by examiner

*Primary Examiner*—Sophia S. Chen
(74) *Attorney, Agent, or Firm*—Westerman, Hattori, Daniels & Adrian, LLP.

(57) ABSTRACT

A consumable-article detecting apparatus used to inform an operator that consumable article is unsuitable for an image forming apparatus includes a physical property detector that detects a physical property value of a consumable article used for the image forming apparatus, and a determination part that determines, based on an output from the physical property detector, whether or not the physical property value of the consumable article is within a predetermined range.

7 Claims, 16 Drawing Sheets

CONSUMABLE-ARTICLE DETECTING APPARATUS, METHOD AND PROGRAM, AND IMAGE FORMING APPARATUS

This application is a continuation based on PCT International Application No. PCT/JP03/09136, filed on Jul. 17, 2003, which is hereby incorporated by reference herein in its entirety as if fully set forth herein.

BACKGROUND OF THE INVENTION

The present invention relates generally to a consumable-article detecting apparatus that is used for an image forming apparatus and detects a consumable article, such as a developer (e.g., toner), and more particularly to a consumable-article detecting apparatus, method and program, which detect toner's physical properties, used in an electrophotographic image forming apparatus, and the image forming apparatus having the consumable-article detecting apparatus.

The present invention is suitable, for example, for an electrophotographic image forming apparatus, such as a printer, a facsimile machine, and a copier. The "electrophotographic image forming apparatus," as used herein, means an apparatus that utilizes the Carson process disclosed in U.S. Pat. No. 2,297,691, e.g., typically a laser printer or a non-impact image forming apparatus that adheres toner to a recording medium, such as a printing paper and an OHP film, for recording.

The laser printers among the electrophotographic recording apparatuses are fast, high-resolution and high-quality apparatuses, and are increasingly demanded along the recent office automation. With the increased demands, the laser printers are required to have a more improved printing quality, durability and maintainability.

The laser printer generally includes a photosensitive drum and an optical unit that forms a latent image on the photosensitive drum through exposure. The photosensitive drum is charged negative uniformly by a precharger, exposed by a laser beam emitted from the optical unit, and forms the latent image after a portion to which the developer is adhered is discharged. The latent image is visualized as a toner image via a developing unit, and the toner image is transferred onto a printing paper by a transfer unit. A fixing unit fixes the toner image transferred onto the printing paper, and then the printing paper is ejected.

The recent mainstream is a print-unit laser printer that incorporates a toner cartridge, the photosensitive drum, the development unit etc. into a print unit as a printing member. The print-unit system enables a user to exchange the print unit and to easily restore the printing quality when the printing quality of the laser printer lowers after the long-term use. This system dispenses with a specific maintenance person for maintenance, and enables a user to easily and conveniently maintain the printer by himself. When it is unnecessary to exchange the entire print unit, the printing quality can easily be recovered by exchanging a toner cartridge in the print unit.

As discussed above, the laser printer uses optimally designed print unit, toner etc. Laser-printer manufactures generally manufacture and sell print units suitable for their laser printers. The manufactures fully inspect and study the adaptabilities of their print units as so-called genuine products to their laser printers: The laser printer equipped with the corresponding print unit can exhibit its maximum printing performance, such as high resolution and high quality, with no transferring and fixing problems.

For example, one proposed developing unit stops agitating recycle toner and refilling the recycle toner to a developer agitator when detecting a predetermined condition in exchanging the developer, thereby preventing excessive refilling of the toner (see, for example, Japanese Patent Application, Publication No. 2002-341634). Another proposed printer identifies an unauthorized recyclable toner cartridge to exclude its use (see, for example, Japanese Patent Application, Publication No. 2001-215779). Still another printer solves a problem of the uncontrollability of the toner concentration when a toner concentration sensor indicates an abnormal output value, because the charge amount of the developer initially put in the developing unit drastically varies due to the ambient conditions in the maintenance of the developer (see, for example, Japanese Patent Application, Publication No. 10-333418).

A print unit and a toner cartridge equipped with an IC chip that can store information have reduced to practice. A user can recognize the exchange time and information of whether it is time to exchange the print unit by storing, in the IC chip, control information, such as printing number and use time.

However, recently, non-genuine or universal products that are not the genuine products have frequently been sold. The non-genuine print units or so-called pirated articles are those which a third party manufactures and sells without an authorization of the original manufacturer. The adaptability between the non-genuine product and the laser printer is not usually fully studied and an application of the non-genuine product to the laser printer would deteriorate the printing quality and transferring and fixing faults.

In addition, non-genuine toner can be used rather than a non-genuine print unit. When the non-genuine toner is put in a toner cartridge after the genuine toner runs short in the toner cartridge, the printing quality can deteriorate and the transferring and fixing faults can occur.

For example, when a printer that has a developing roller as a magnet roller uses more magnetic non-genuine toner than the genuine toner, the attraction force of the developing roller increases and the printing concentration is thinner than the normal one. Conversely, when the printer uses less magnetic non-genuine toner than the genuine toner, the attraction force of the development roller decreases and the printing concentration is thicker than the normal one.

When these non-genuine products are manufactured and sold, the genuine printer manufacture suffers from reduced sales amount and profit, and should arduously handle users' complaints, such as fault reports and repair requests, when the above faults occur. It is conceivable to detect the non-genuine products by using the above IC chips, but this method makes the print unit and toner cartridge expensive. In addition, this method can detect the non-genuine print unit and toner cartridge, but does not work when non-genuine toner is put in the genuine print unit and toner cartridge instead of the genuine toner.

BRIEF SUMMARY OF THE INVENTION

Therefore, it is an exemplified general object of the present invention to provide a novel and useful consumable-article detecting apparatus, method and program, and an image forming apparatus, in which the prior art problems are eliminated. Another and more specific object of the present invention is to provide consumable-article detecting apparatus, method and program, and an image forming apparatus, which can avoid various problems due to use of an unsuitable consumable article.

For example, one object of the present invention is to prevent faults, such as lowered printing quality, toner adhesions, and paper jams due to use of improper toner for an image forming apparatus, such as a laser printer and a facsimile machine. Another object of the present invention is to prevent a fault due to use of a print unit unsuitable for the image forming apparatus, and to enable a user to safely use the image forming apparatus.

A consumable-article detecting apparatus according to one aspect of the present invention used to inform an operator that consumable article is unsuitable for an image forming apparatus includes a physical property detector that detects a physical property value of a consumable article used for the image forming apparatus, and a determination part that determines, based on an output from the physical property detector, whether or not the physical property value of the consumable article is within a predetermined range. The consumable-article detecting apparatus can determine that the consumable article is unsuitable for the image forming apparatus when the physical property of the consumable article is not within the predetermined range. For example, when the image forming apparatus includes an informing means that informs an operator or user of the unsuitableness and includes a computer connected to the image forming apparatus, the user can easily recognize that the consumable article is unsuitable. Thus, the consumable-article detecting apparatus prevents a deterioration of the printing quality or a fault of the image forming apparatus due to inadvertent use of a non-genuine consumable article unsuitable for the image forming apparatus.

The physical property detector may be a magnetic permeameter that detects a magnetic permeability of toner, and the determination part may determine based on a value of a high output peak from the magnetic permeameter. The consumable-article detecting apparatus may determine the adaptability of the toner to the image forming apparatus based on the toner's magnetic permeability. Since the toner's adaptability is determined based on a value of the high output peak of the magnetic permeameter, the unsuitable toner can be surely detected and the lowered printing quality and fault can be surely prevented. The "high output peak of the magnetic permeameter," as used herein, means a convex output waveform portion that projects toward the high output side in the approximately periodically varying output waveform from the magnetic permeameter.

The physical property detector may be a magnetic permeameter that detects a magnetic permeability of toner, and the determination part may determine based on a value of a midpoint between two adjacent low output peaks from the magnetic permeameter. The consumable-article detecting apparatus may determine the adaptability of the toner to the image forming apparatus based on the toner's magnetic permeability. Since the toner's adaptability is determined based on a value of a midpoint between two adjacent low output peaks from the magnetic permeameter, the unsuitable toner can be surely detected and the lowered printing quality and fault can be surely prevented. The "low output peak of the magnetic permeameter," as used herein, means a convex output waveform portion that projects toward the low output side in the approximately periodically varying output waveform from the magnetic permeameter.

The physical property detector may be a magnetic permeameter that detects a magnetic permeability of toner, and the determination part may determine based on a time interval of a low output peak having a predetermined output value from the magnetic permeameter. The consumable-article detecting apparatus may determine the adaptability of the toner to the image forming apparatus based on the toner's flowability. The toner's adaptability is determined based on the flowability by utilizing that the time interval of the low output peak having the predetermined output value from the magnetic permeameter is an index of the toner's flowability. Therefore, the unsuitable toner can be surely detected and the lowered printing quality and fault can be surely prevented.

The consumable-article detecting apparatus may further include a loading/refilling detector that detects loading or refilling of the consumable article in the image forming apparatus, and a detection of the physical property value of the consumable article by the physical property detector may follow a detection of loading or refilling of the consumable article by the loading/refilling detector. The consumable-article detecting apparatus can determine the adaptability of the consumable article based on the physical property value just after the loading or refilling. Just after the loading or refilling, the physical property value is stable without variation with time, and the adaptability of the consumable article can be surely determined. As a result, the lowered printing quality and fault caused by use of the unsuitable toner can be surely prevented. When the loading/refilling detector serves as the physical property detector, additional effects are available, such as the number of components reduces and the apparatus's cost lowers.

The consumable-article detecting apparatus may further include a residue detector that detects residue of the toner in the image forming apparatus, and serves as the physical property detector. The residue detector serves as the physical property detector, and detects both the toner's residue and physical property without increasing the number of components and apparatus's cost.

A consumable-article detecting method according to another aspect of the present invention includes the steps of detecting a physical property value of a consumable article used for an image forming apparatus, determining whether or not the physical property value is within a predetermined range, and informing an operator that the consumable article is unsuitable for the image forming apparatus. The consumable-article detecting method can determine that the consumable article is unsuitable for the image forming apparatus when the physical property of the consumable article is not within the predetermined range. For example, when the image forming apparatus includes an informing means that informs an operator or user of the unsuitableness and includes a computer connected to the image forming apparatus, the unsuitableness of the consumable article can be indicated on the computer screen. When the informing means may use a sound to inform the user of the unsuitableness of the consumable article. Thus, the user can easily recognize that the consumable article is unsuitable, and the consumable-article detecting method prevents a deterioration of the printing quality or a fault of the image forming apparatus due to inadvertent use of an unsuitable consumable article.

A computer-executable consumable-article detecting program according to still another aspect of the present invention includes the steps of detecting a physical property value of a consumable article used for an image forming apparatus, determining whether or not the physical property value is within a predetermined range, and informing an operator that the consumable article is unsuitable for the image forming apparatus. The consumable-article detecting program can determine that the consumable article is unsuitable for the image forming apparatus when the physical property of the consumable article is not within the predetermined range. For example, when the image forming apparatus includes an informing means that informs an operator or user of the unsuitableness and includes a computer connected to the image forming apparatus, the unsuitableness of the consumable article can be indicated on the computer screen. When the informing means may use a sound to inform the user of the unsuitableness of the consumable article. Thus, the user can easily recognize that the consumable article is unsuitable, and the consumable-article detecting program prevents a deterioration of the printing quality or a fault of the image forming apparatus due to inadvertent use of an unsuitable consumable article.

The informing step may be an alarm of a possible fault. The consumable-article detecting program can effectively prevent use of the unsuitable consumable article through the alarm of the possible fault of the image forming apparatus if the consumable article that is determined unsuitable is used as well as informing that the consumable article is unsuitable. As a result, the consumable-article detecting program prevents a deterioration of the printing quality or a fault of the image forming apparatus due to inadvertent use of an unsuitable consumable article. The consumable-article detecting program may be firmware in the image forming apparatus or a driver software installed in the computer connected to the image forming apparatus. Of course, the firmware and driver software cooperatively serve as the consumable-article detecting program.

An image forming apparatus according to another aspect of the present invention includes a medium supply part that supplies a recording medium, a printing unit that forms a toner image, a medium ejecting part that ejects the recording medium on which the image was formed, and the above consumable-article detecting apparatus. The consumable-article detecting apparatus can determine that the consumable article is unsuitable for the image forming apparatus when the physical property of the consumable article is not within the predetermined range. For example, when the image forming apparatus includes an informing means that informs an operator or user of the unsuitableness and includes a computer connected to the image forming apparatus, the user can easily recognize that the consumable article is unsuitable. Thus, the consumable-article detecting apparatus prevents a deterioration of the printing quality or a fault of the image forming apparatus due to inadvertent use of a non-genuine consumable article unsuitable for the image forming apparatus.

The physical property detector may be a magnetic permeameter that detects a magnetic permeability of toner, and the determination part may determine based on a value of a high output peak from the magnetic permeameter. The consumable-article detecting apparatus may determine the adaptability of the toner to the image forming apparatus based on the toner's magnetic permeability. Since the toner's adaptability is determined based on a value of the high output peak of the magnetic permeameter, the unsuitable toner can be surely detected and the lowered printing quality and fault can be surely prevented. The "high output peak of the magnetic permeameter," as used herein, means a convex output waveform portion that projects toward the high output side in the approximately periodically varying output waveform from the magnetic permeameter.

The physical property detector may be a magnetic permeameter that detects a magnetic permeability of toner, and the determination part may determine based on a value of a midpoint between two adjacent low output peaks from the magnetic permeameter. The consumable-article detecting apparatus may determine the adaptability of the toner to the image forming apparatus based on the toner's magnetic permeability. Since the toner's adaptability is determined based on a value of a midpoint between two adjacent low output peaks from the magnetic permeameter, the unsuitable toner can be surely detected and the lowered printing quality and fault can be surely prevented. The "low output peak of the magnetic permeameter," as used herein, means a convex output waveform portion that projects toward the low output side in the approximately periodically varying output waveform from the magnetic permeameter.

The physical property detector may be a magnetic permeameter that detects a magnetic permeability of toner, and the determination part may determine based on a time interval of a low output peak having a predetermined output value from the magnetic permeameter. The consumable-article detecting apparatus may determine the adaptability of the toner to the image forming apparatus based on the toner's flowability. The toner's adaptability is determined based on the flowability by utilizing that the time interval of the low output peak having the predetermined output value from the magnetic permeameter is an index of the toner's flowability. Therefore, the unsuitable toner can be surely detected and the lowered printing quality and fault can be surely prevented.

The consumable-article detecting apparatus may further include a loading/refilling detector that detects loading or refilling of the consumable article in the image forming apparatus, and a detection of the physical property value of the consumable article by the physical property detector may follow a detection of loading or refilling of the consumable article by the loading/refilling detector. The consumable-article detecting apparatus can determine the adaptability of the consumable article based on the physical property value just after the loading or refilling. Just after the loading or refilling, the physical property value is stable without variation with time, and the adaptability of the consumable article can be surely determined. As a result, the lowered printing quality and fault caused by use of the unsuitable toner can be surely prevented. When the loading/refilling detector serves as the physical property detector, additional effects are available, such as the number of components reduces and the apparatus's cost lowers.

The consumable-article detecting apparatus may further include a residue detector that detects residue of the toner in the image forming apparatus, and serves as the physical property detector. The residue detector serves as the physical property detector, and detects both the toner's residue and physical property without increasing the number of components and apparatus's cost.

Other objects and further features of the present invention will become readily apparent from the following description of the embodiments with reference to accompanying drawings.

BRIEF DESCRIPTION OF THE DRAWINGS

4A shows a state before the cleaner cleans the sensor surface, and FIG. 4B shows a state while the cleaner is cleaning the sensor surface.

FIGS. 14A and 14B are graphs showing output waveforms from the magnetic permeameter according to the fourth embodiment, wherein FIG. 14A is the output waveform with toner having good flowability, and FIG. 14B is the output waveform with toner having bad flowability.

DETAILED DESCRIPTION OF THE INVENTION

Figure 1:
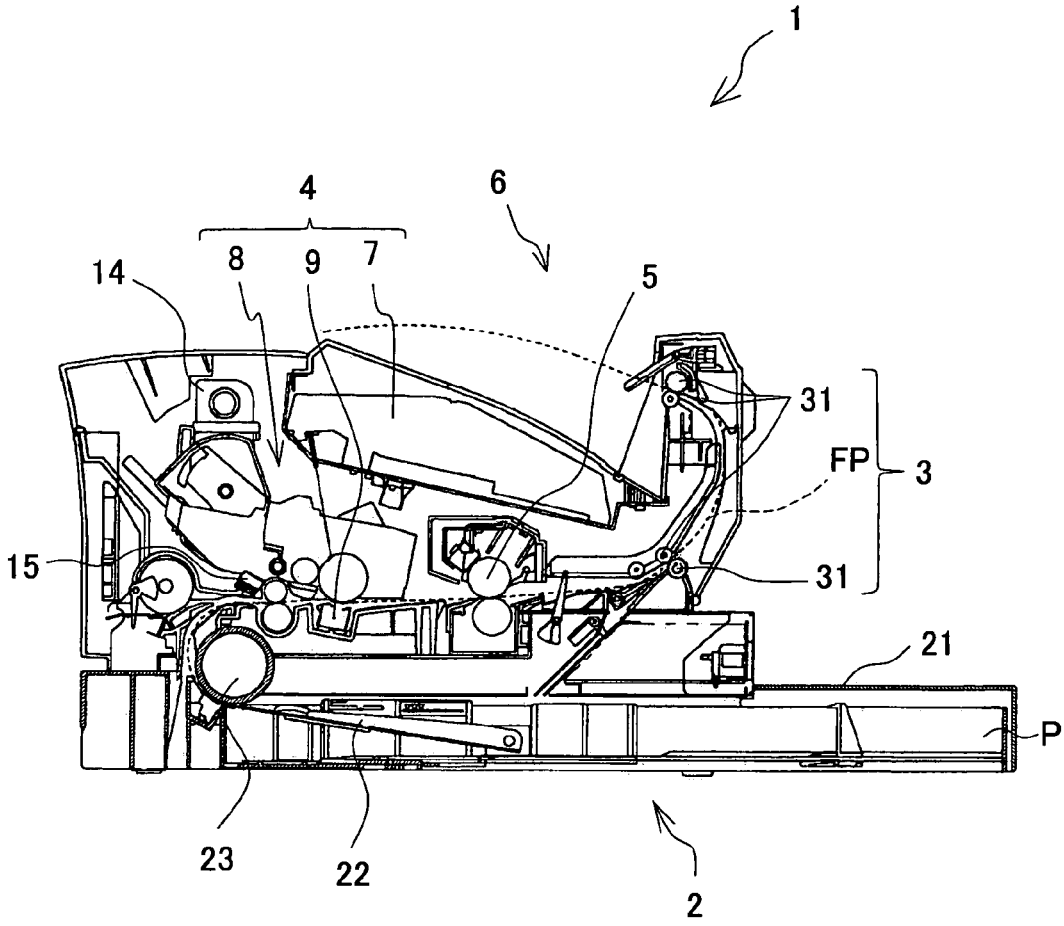
FIG. 1 is a sectional view of an internal structure of a laser printer according to a first embodiment of the present invention.

Referring now to the accompanying drawings, a description will be given of a consumable-article detecting apparatus and an image forming apparatus having the same according to a first embodiment of the present invention. FIG. 1 is a sectional view of the laser printer 1 as an image forming apparatus. The laser printer 1 includes a paper supply part 2 serving as a recording medium supply part, a feeding part 3, an image forming unit 4, a fixing unit 5, and a paper ejecting part 6 serving as a recording medium ejecting part.

The paper supply part 2 includes a paper supply cassette 21 that houses plural recording media or papers P, a hopper 22, and a paper supply roller 23, wherein the hopper 22 picks up a top paper in the paper supply cassette 21 and supplies the top paper to the feeding part 3 in the laser printer 1. The hopper 22 is forced in an upper direction in FIG. 1 by a compression spring and pushes up the paper P. The paper supply roller 23 is also referred to as a pickup roller, and contacts the top recording paper P in the recording papers P in the paper supply cassette 21, and sends it one by one.

The feeding part 3 feeds the recording paper P supplied from the paper supply part 2 from the recording paper 3 to the paper ejecting part 6 at the top of the laser printer 1 along a feed path FP. The feeding part 3 has various (driving and driven) feed rollers 31. These feed rollers 31 feed the paper P counterclockwise in FIG. 1, and eject it from the paper ejecting part 6.

The image forming unit 4 forms a desired toner image, transfers the image onto the recording paper P, and includes an image exposure unit 7, a print unit 8, a transfer unit 9. The image exposure unit 7 irradiates exposure light, such as a laser beam, to a photosensitive drum 83, which will be described later, based on information of an image to be formed, and forms an electrostatic latent image on the photosensitive drum 83.

Figure 2:
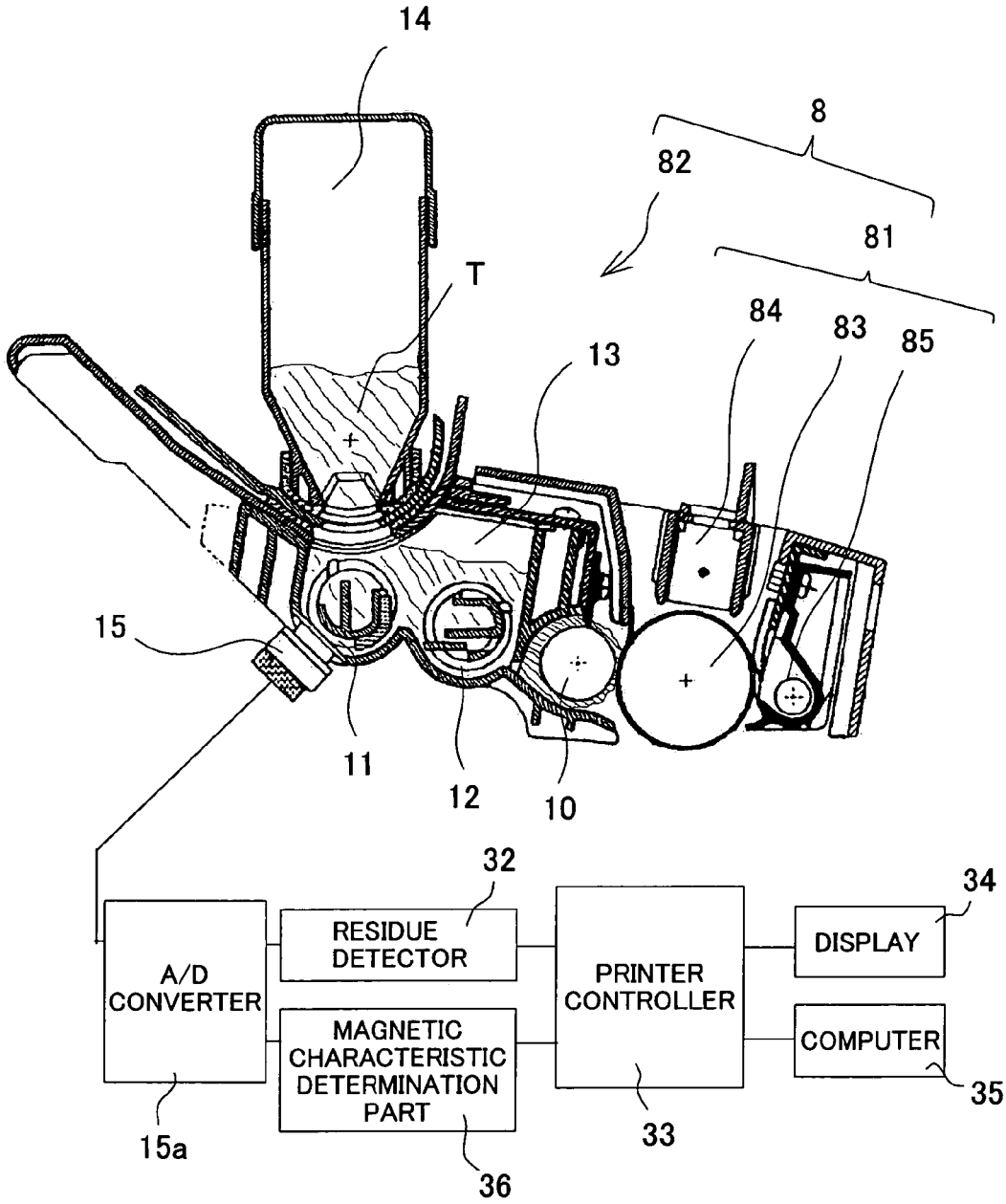
FIG. 2 is a sectional view of principal part of a print unit in the laser printer shown in FIG. 1, and a block diagram of a schematic structure of a consumable-article detecting apparatus.

The print unit 8 includes, as shown in FIG. 2, a drum unit 81 and a developing unit 82, and the drum unit 81 includes the photosensitive drum 83, a precharger 84, and a drum cleaner 85. The print unit 8 is detachably provided to the laser printer 1, and exchanged as the consumable article when it cannot maintain the given performance after working for a predetermined time period and printing the predetermined number of papers.

The photosensitive drum 83 has a photosensitive dielectric layer on a rotatable drum conductive support member, and serves to hold an image. For example, the photosensitive drum 83 is made of an aluminum drum to which a separated-function organic photosensitive material is applied with a thickness of about 20 μm. The photosensitive drum 83 may have an outer diameter of 30 mm and rotate at a circumferential speed of 79 mm/s. After the precharger 84 uniformly charges the surface of the photosensitive drum 83, the exposure light source forms a latent image. The formed latent image is visualized or developed by the toner supplied from a toner hopper 13 of the developing unit 82, and the transfer unit 9, which will be described later, transfers the toner onto the recording paper P, forming an image on the recording paper P.

The precharger 84 includes, for example, a scorotron charger and provides a certain charge amount, such as about −540V to a surface of the photosensitive drum 83. A drum cleaner 85, such as a cleaning blade, removes the residue toner from the surface of the photosensitive drum 83 after the toner is transferred onto the recording paper P. A recycling mechanism (not shown) returns the toner cleaned by the drum cleaner 85 to the toner hopper 13 for reuse.

The developing unit 82 serves to visualize or develop the electrostatic latent image on the photosensitive drum 83 into a toner image. The developing unit 82 includes a developing roller 10, a first agitator 11, a second agitator 12, and the toner hopper 13. The first embodiment uses toner T for the developer. The toner T is a consumable article, decreases after used, and should be refilled as necessity arises. A toner cartridge 14 stores the toner T, and the toner T is supplied to the toner hopper 13 when the toner cartridge 14 is attached to the print unit 8. The toner may be magnetic and non-magnetic, and the developer may be a single component that consists of the toner and two components that include ferromagnetic carrier and magnetic toner. The first embodiment uses the magnetic toner as the toner T, and a mixture of the toner T and the ferromagnetic carrier as the developer. The mixture ratio is automatically adjusted on the developing roller 10.

The developing roller 10 accommodates a fixed magnetic pole, and an outer sleeve rotates and supplies the magnetic toner to the photosensitive drum 83, developing the electrostatic latent image on the photosensitive drum 83. The developer as a mixture of ferromagnetic carrier and magnetic toner T is supplied around the developing roller 10. When the toner T decreases in the toner hopper 13, an output waveform from a magnetic permeameter that serves as a residue detector, which will be described later, informs a user of the toner empty. The user or operator thus recognizes that the toner T is running short, and exchanges the toner cartridge 14 to refill the toner T.

Figure 3:
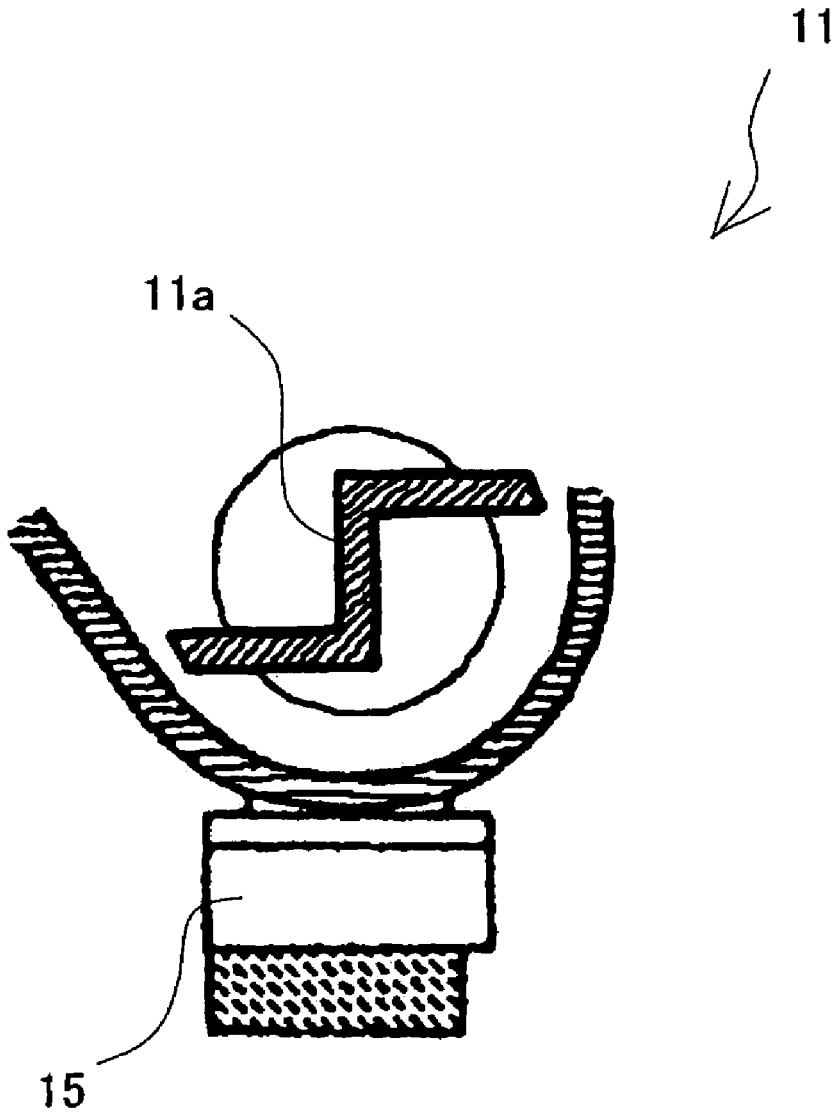
FIG. 3 is a sectional view of a first agitator and a magnetic permeameter.

The first agitator 11 and the second agitator 12 agitate the toner T in the toner hopper 13 and send it to the developing roller 10. As FIG. 3 shows its section, the first agitator 11 has a plate 11*a* that extends along the rotational shaft and has a crank-shaped section, and the plate 11*a* agitates and sends the toner T to the developing roller 10. The second agitator 12 has a similar structure, and a description thereof will be omitted.

The transfer unit 9 has a transfer roller. The transfer roller generates an electric field that electrostatically attracts the toner T from a rear surface of the recording paper P or a surface opposite to a surface that faces the photosensitive drum 83.

The fixing unit 5 semipermanently fixes a toner image on the recording paper P transferred by the transfer unit 9. The toner T just after the transfer adheres to the recording paper P by the electrostatic force, and easily comes off when receiving the external force. The fixing unit 5 melts and compresses the toner T into the recording paper P by applying the heat and pressure to it so that the toner T permeates and fixes in the recording paper P. The paper ejecting part 6 ejects the fixed recording paper P that has been fed by the feeding part 3.

The magnetic permeameter 15 serves as a residue detector and is provided to the body of the laser printer 1 near the first agitator 11 when the print unit 8 is attached to the body of the laser printer 1. The magnetic permeameter 15 is a sensor that measures the magnetic permeability of the toner T in the toner hopper 13 near the first agitator 11. The magnetic permeameter 15 includes an excitation coil and a detection coil wound around the sensor head. It detects the magnetic permeability of a target (or the toner T in the first embodiment), since the voltage at the detection coil side excited by the constant AC current through the excitation coil changes according to the magnetic permeability of the target that contacts the sensor head. As described later, the magnetic permeameter 15 also serves as both a loading/refilling detector and a physical property detector. When the toner T is sufficiently supplied to the toner hopper 13, the toner T's magnetic permeability is detected high, while as the toner T decreases in the toner hopper 13, the toner T's magnetic permeability is detected lower. Thereby, the residue of the toner T can be detected according to the output of the magnetic permeameter 15.

The output from the magnetic permeameter 15 is AD-converted by the AD converter 15*a*, and sent to a residue determination part 32. The residue determination part 32 determines the residue of the toner T based on the output signal from the magnetic permeameter 15. For example, the toner T remains sufficiently, the residue determination part 32 does not output any signal. However, when the residue determination part 32 determines that the residue of the toner T is slightly small although that does not affect the printing quality, the residue determination part 32 outputs a nearly empty signal to a printer controller 33. When the residue of the toner T too small to maintain the printing quality, the residue determination part 32 determines that the toner runs short and outputs an empty signal to the printer controller 33.

For example, when the output of the magnetic permeameter 15 is approximately always greater than a predetermined value, the residue determination part 32 determines that the residue of the toner T is sufficient. The residue determination part 32 determines that the residue of the toner T is slightly small when the output of the magnetic permeameter 15 often becomes lower than the predetermined value. The residue determination part 32 determines that the toner T runs short when the frequency at which the output of the magnetic permeameter 15 is lower than the predetermined value is greater than a preset value. Alternatively, for example, the residue determination part 32 determines that the residue of the toner T is sufficient when the output of the magnetic permeameter 15 is greater than a first predetermined value, that the residue of the toner T is slightly small when the output of the magnetic permeameter 15 is lower than the first predetermined value, and that the toner T runs short when the output of the magnetic permeameter 15 is lower than a second predetermined value lower than the first predetermined value.

The print controller 33 indicates "the toner almost runs short" on a display 34 of the laser printer 1 and a screen of a computer 35 connected to the laser printer 1 via a network, when receiving the near empty signal. The print controller 33 indicates "no toner" on the display 34 and a screen of a computer 35 and stops the operation of the laser printer 1, when receiving the empty signal. The printer controller 33 controls the entire operations of the laser printer 1 and includes, for example, a computer equipped with a CPU. The printer controller 33 stores a consumable-article detecting program that runs a series of procedures of the consumable article detection, which will be described later.

Although the consumable-article detecting program is stored as firmware in the printer controller 33 in the laser printer 1 in the first embodiment, it may be installed as driver software in the computer 35. Of course, the firmware and the printer driver software may cooperatively serve as the consumable-article detecting program.

When the toner runs short, the user detaches the empty toner cartridge 14 form the print unit 8, and attaches a new toner cartridge 14 filled with the toner T to the print unit 8, thereby supplying new toner T to the toner hopper 13.

The print unit 8 is provided with a loading/refilling detector that detects loading of the print unit 8 and refilling of the toner T. In this first embodiment, the magnetic permeameter 15 serves as the loading/refilling detector, to detect loading of the print unit 8 and refilling of the toner T. When the residue of the toner T increases, for example when the output of the magnetic permeameter 15 becomes high after the toner runs short, it can be determined that the print unit 8 is exchanged and then loaded or that the toner T is refilled. The residue determination part 32 determines loading and refilling.

The print unit 8 includes a physical property detector that detects a physical property value of the consumable article, such as the toner T and the print unit 8. In this first embodiment, the magnetic permeameter 15 serve as the physical property detector that detects the magnetic permeability as the physical property value of the toner T. The physical property value of the consumable article varies according to the manufactures of the consumable article, and the laser printer 1 is adjusted and manufactured so that it exhibits the maximum performance with the genuine consumable article. Conceivably, the laser printer 1 with a non-genuine consumable article cannot exhibit satisfactory performance or can break down. After the magnetic permeameter 15 detects the magnetic permeability of the toner T, a magnetic characteristic determination part 36 determines whether the magnetic permeability of the toner T is within a predetermined range and thus the laser printer 1 can determine whether or not the toner T is a genuine product.

For example, when the toner T's magnetic permeability detected by the magnetic permeameter 15 is within a predetermined range, the magnetic characteristic determination part 36 sends to the printer controller 33 an OK signal that indicates that the toner T is a genuine product. When the toner T's magnetic permeability is not within a predetermined range, the magnetic characteristic determination part 36 sends to the printer controller 33 an NG signal that indicates that the toner T is a non-genuine product.

The printer controller 33 does not indicate any message on the display 34 and the screen of the computer 35 when receiving the OK signal, and the user continues to use the laser printer 1. However, when receiving the NG signal, the printer controller 33 indicates a message on the display 34 and the screen of the computer 35 informing the user that the toner T is a non-genuine product. This message may be, for example, "the toner is a non-genuine product," or alarms the user that "use of this toner would deteriorate the printing quality or break down the printer." If necessary, in addition to the above message, an additional message of "do you continue to print?" may be indicated to ask the user to determine whether he should continue to use the printer.

The physical property value of the consumable article, such as the toner T's magnetic permeability, often varies with time even when it has a constant initial characteristic. Therefore, in order to maintain the high precision, it is preferable to detect the physical property value and determine whether it is within the predetermined range before the physical property value varies with time. The first embodiment determines whether the magnetic permeability of the toner T is within the predetermined range, just after the toner T is refilled or the print unit 8 is loaded. When the residue determination part 32 determines that the residue of the toner T increases, it is assumed that that the toner T is refilled or a new print unit 8 is loaded and the magnetic characteristic determination part 36 determines the toner T's magnetic permeability just after the determination. Thereby, whether or not the toner T is the genuine product can be precisely determined without influence of the variation with time.

Figure 4A:
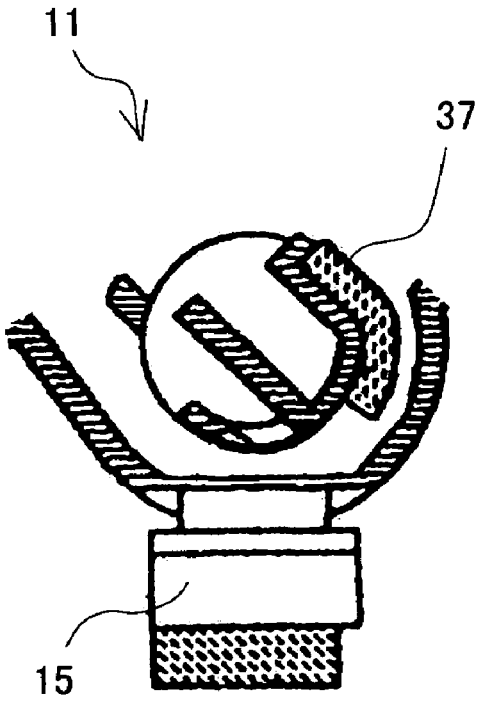
FIGS. 4A and 4B are sectional views how a cleaner cleans a sensor surface of the magnetic permeameter, wherein FIG.
Figure 4B:
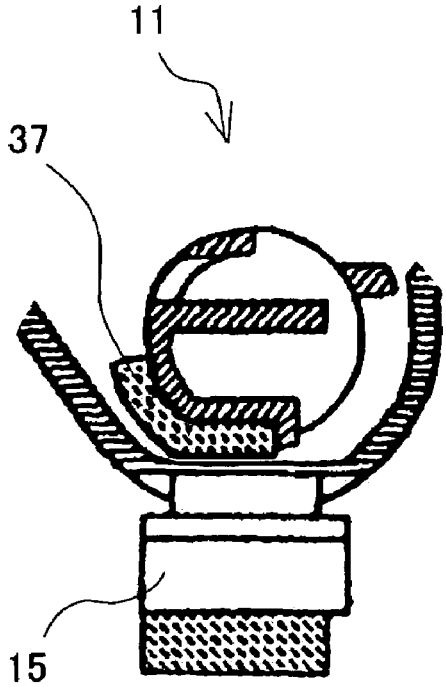
Figure 5:
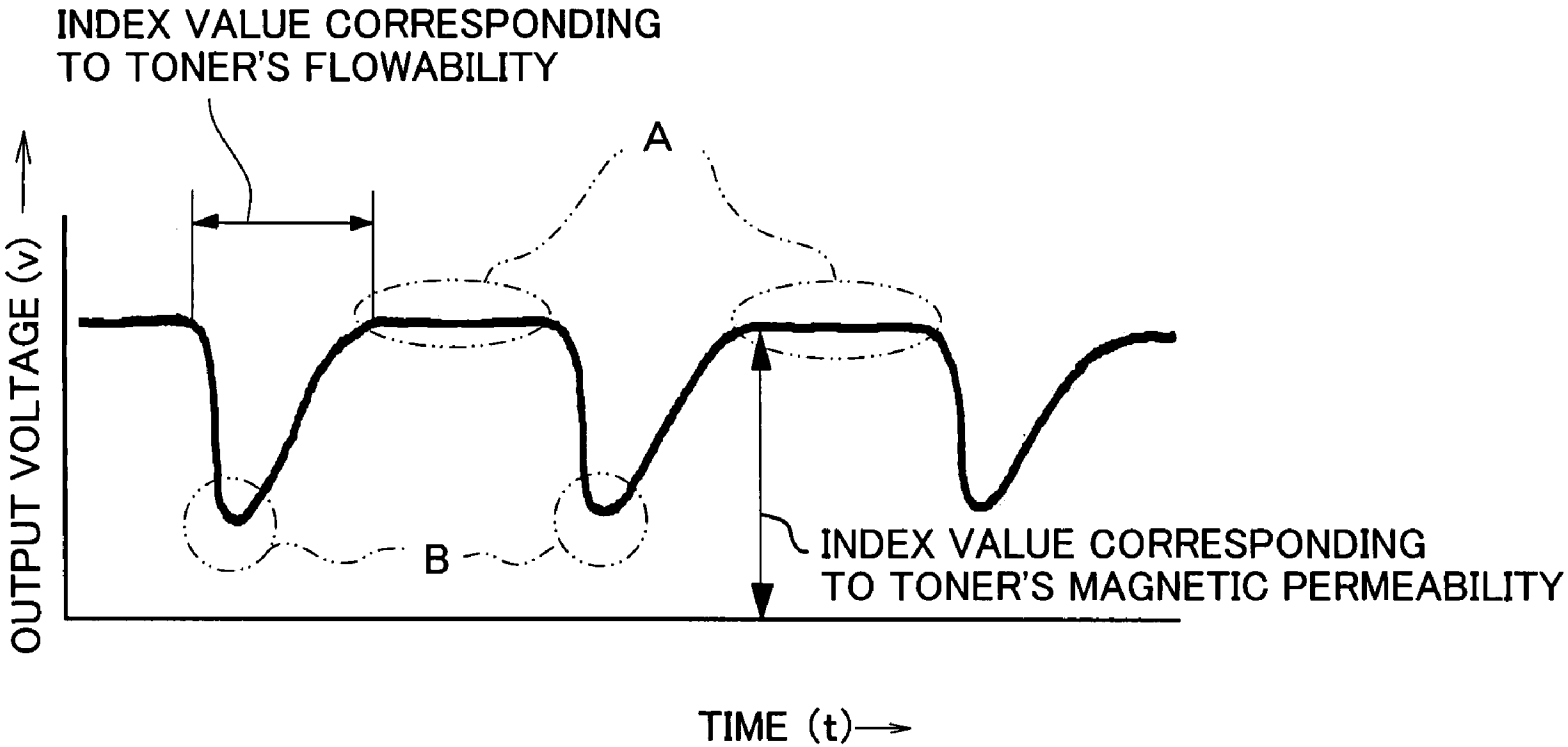
FIG. 5 is a graph showing an illustrative output waveform from the magnetic permeameter.

The first agitator 11 is configured to extend in a direction perpendicular to the paper surface of FIG. 4. A cleaner 37 that cleans the sensor surface of the magnetic permeameter 15 is provided at its portion opposing to the magnetic permeameter 15. The cleaner 37 is made of sponge, a brush, etc., and partially projects, as shown in FIG. 4, into the circumferential surface of the first agitator 11. As the first agitator 11 rotates, the cleaner 37 repetitively cleans the sensor surface of the magnetic permeameter 15 at a constant period. FIG. 5 shows an output waveform from the magnetic permeameter 15.

In FIG. 5, the abscissa axis denotes time (t), and the ordinate axis denotes the output voltage value (V) from the magnetic permeameter 15. When the toner hopper 13 has a sufficient amount of the toner T, the output value from the magnetic permeameter 15 is high as shown by an area A. This output value is an index value corresponding to the magnetic permeability of the toner T or a physical property value unique to the toner T, and is different according to the types of the toner. A convex output area that projects toward the high output side like the area A is referred to as a high output peak. As the first agitator 11 rotates and the cleaner 37 cleans the sensor surface of the magnetic permeameter 15, the toner T is removed from the sensor surface and the output temporarily drops like an area B. However, as the time elapses, the surrounding toner T deposits on the sensor surface again and the output value of the magnetic permeameter 15 becomes a high output value as shown by the area A. As shown by the area B, a convex output area projecting towards the low output value side is referred to as a low output peak.

The first agitator 11 repetitively rotates at a predetermined period, and thus the cleaner 37 repetitively cleans the sensor surface of the magnetic permeameter 15 at a predetermined period. Therefore, the output waveform of the magnetic permeameter 15 has a waveform that repeats the high output and low output at a constant period. A time period after the cleaner 37 removes the toner T from the sensor surface and before the toner T deposits on the sensor surface is an index value corresponding to the flowability of the toner T. This flowability is also a physical property value unique to the toner T, and different according to the types of the toner. The toner's flowability can be determined based on a time period from the low output value shown by the area B to the high output value shown by area A, and whether or not the toner is a genuine product can be determined based on the flowability.

While the first embodiment uses the laser printer 1 for an illustrative image forming apparatus, the present invention may use another electrophotographic image forming apparatus, such as a facsimile machine and a copier. In addition, the recording medium is not limited to the recording paper P, but may cover a recording film sheet or another medium that forms an image on its surface using the toner.

Figure 6:
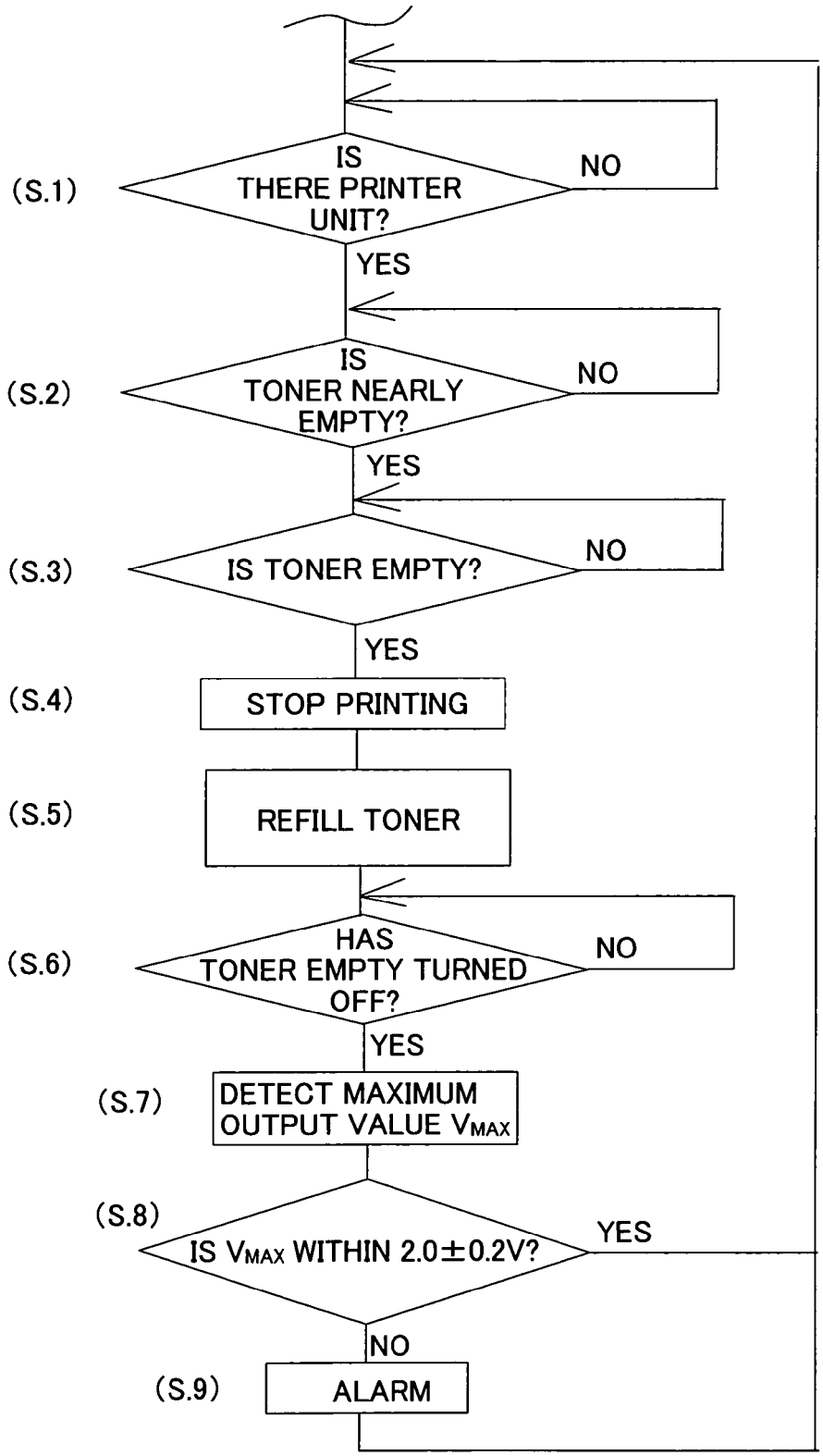
FIG. 6 is a flowchart for explaining a determination procedure of the toner's magnetic permeability in the laser printer according to the first embodiment of the present invention.

A description will be given of how the laser printer 1 determines the magnetic permeability of the toner T. FIG. 6 is a flowchart for explaining a determination procedure of the toner's magnetic permeability in this laser printer 1. In the first embodiment, the photosensitive drum 83 rotates a circumferential speed of 79 mm/s, the first and second agitators 11 and 12 have rotational outer diameters of 20 mm and the number or rotations of 65.5 rpm. The cleaner 37 has a width of 10 mm in a direction perpendicular to the paper surface of FIG. 4. The magnetic permeameter 15 has a detection-signal outputting sampling period of 10 ms.

The magnetic permeameter 15 periodically detects the magnetic permeability of the toner T while the user uses the laser printer 1. The residue determination part 32 determines whether there is the print unit 8, based on the detected toner T's magnetic permeability (S. 1). The residue determination part 32 can determine that the print unit 8 is removed when the toner runs short suddenly from a state in which the toner T's residue is sufficient. For example, the first embodiment determines whether or not there is the print unit 8, based on a difference between the output value (Vmax) in the area A and the output value (Vmin) in the area B. See FIG. 5. When a difference between these two output values is large, an attachment of the print unit 8 is presumed. When a difference between these output values is small (for example, becomes 0.1 V or smaller), a detachment of the print unit 8 is presumed. When it is determined that the print unit 8 is detached, the laser printer 1 indicates an error message of "no toner" etc., similar to case where the toner is empty, informing the user that no printing is available. The laser printer 1 may use non-magnetic toner for the toner T, since there is almost no output difference between Vmax and Vmin.

When the print unit 8 is loaded, the residue determination part 32 determines whether or not the toner is in a nearly empty state (S. 2). The toner's nearly empty state means that the toner's residue decreases, but dose not deteriorate the printing quality, allowing the user to continue to use the laser printer 1. However, in case of the toner's nearly empty state, the laser printer 1 indicates a message of "the toner almost runs short" etc., on the display 34 and the screen of the computer 35, informing the user that the toner is about to run short.

When determining that the toner is in the nearly empty state, the residue determination part 32 next determines whether the toner is in an empty state (S. 3). The toner's empty state means that the toner runs too short to maintain the printing quality. When the residue determination part 32 determines that the toner is in the empty state, the laser printer 1 stops a printing action (S. 4) and indicates a message of "no toner" on the display 34 and the screen of the computer 35.

When the toner runs short, the laser printer 1 cannot be used. Therefore, the user exchanges the current toner cartridge 14 with a new one filled with the toner T and refills the print unit 8 with the toner T (S. 5).

When the toner T is refilled by the above manner, the toner T is supplied to the toner hopper 13 in the print unit 8. Thereby, the magnetic permeameter 15 detects refilling of the toner T, and the toner empty state turns off (S. 6). When the print unit 8 is detached from the laser printer 1, the toner T is refilled, the print unit 8 in which the toner T is supplied to the toner hopper 13 is loaded to the laser printer 1, the magnetic permeameter 15 detects loading of the print unit 8 and refilling of the toner T.

Figure 7:
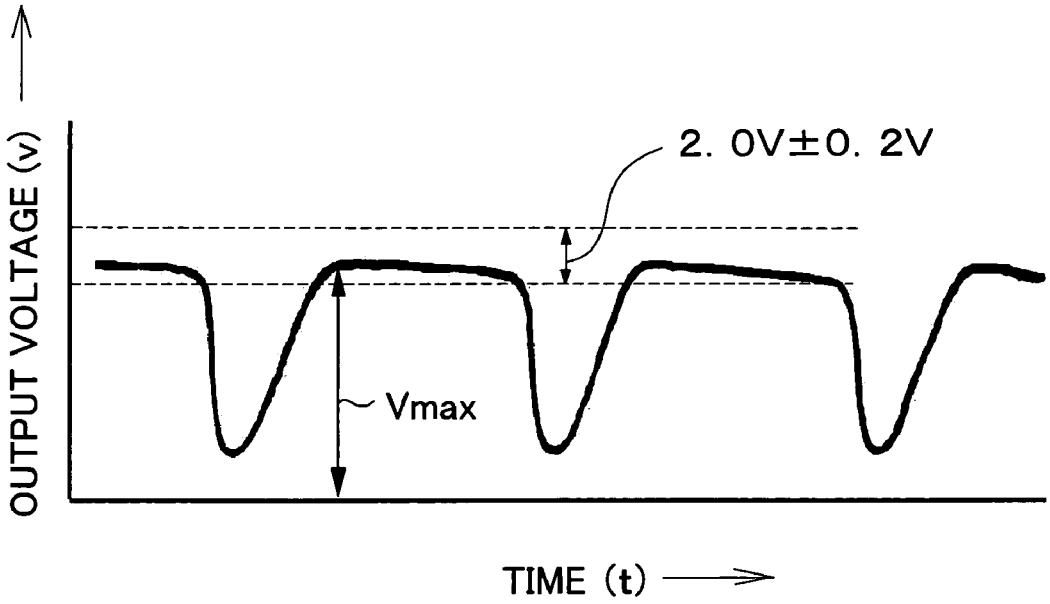
FIG. 7 is a graph showing an output waveform from the magnetic permeameter according to the first embodiment.

When the toner T is refilled and the toner's empty state turns off, whether the toner T is a genuine product is determined based on the subsequent output values of the high output peak of the magnetic permeameter 15. More specifically, among the sampled output values of the magnetic permeameter 15, the maximum output value Vmax is detected (S. 7), and the magnetic characteristic determination part 36 determines whether Vmax is within the predetermined output range (S. 8). The first embodiment sets the predetermined output range to 2.0 V±0.2 V. See FIG. 7.

When the maximum output value Vmax is within 2.0 V±0.2 V, the toner T is apparently a genuine product, and the user can use the laser printer 1 again with no message. When the maximum output value Vmax is not within 2.0 V±0.2 V, the toner T is apparently a non-genuine product unsuitable for this laser printer 1, and the laser printer 1 indicates an alarm message "use of this toner might harm the printing quality or break down the printer" on the display 34 and the screen of the computer 35 (S.9).

The maximum output value Vmax may be repetitively detected for ten periods of the first agitator 11. For improved accuracy of a determination of whether the toner is a genuine product, it is determined that the toner T is a genuine product when all the maximum output values Vmax for ten samples are within 2.0 V±0.2 V, and that the toner T is a non-genuine product when one of the maximum output values Vmax for ten samples is not within 2.0 V±0.2 V.

A description will now be given of a consumable-article detecting apparatus according to a second embodiment of the present invention. The second embodiment is different from the first embodiment in that the magnetic characteristic determination part 36 differently determines the magnetic permeability of the toner T, but other than that the second embodiment is similar to the first embodiment and a description thereof will be omitted.

Figure 8:
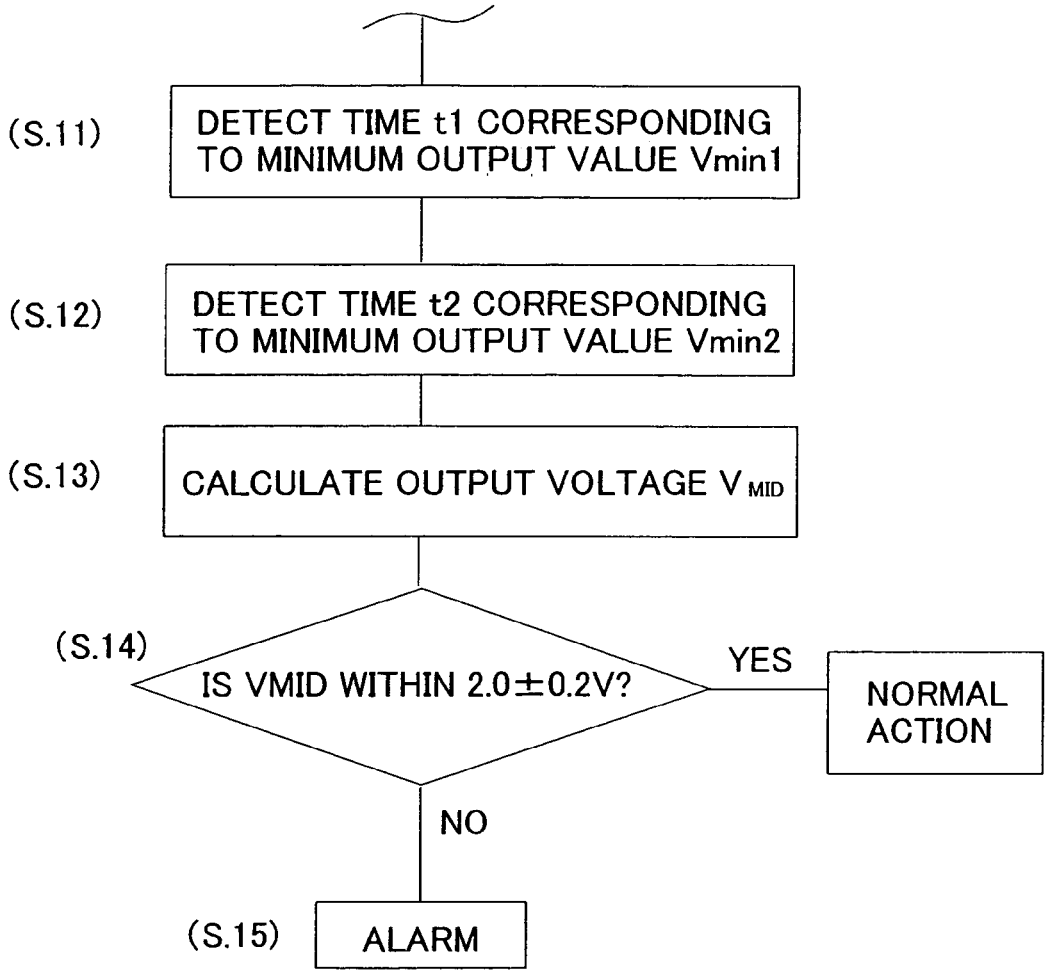
FIG. 8 is a flowchart for explaining a determination procedure of the toner's magnetic permeability in the laser printer according to a second embodiment of the present invention.
Figure 9:
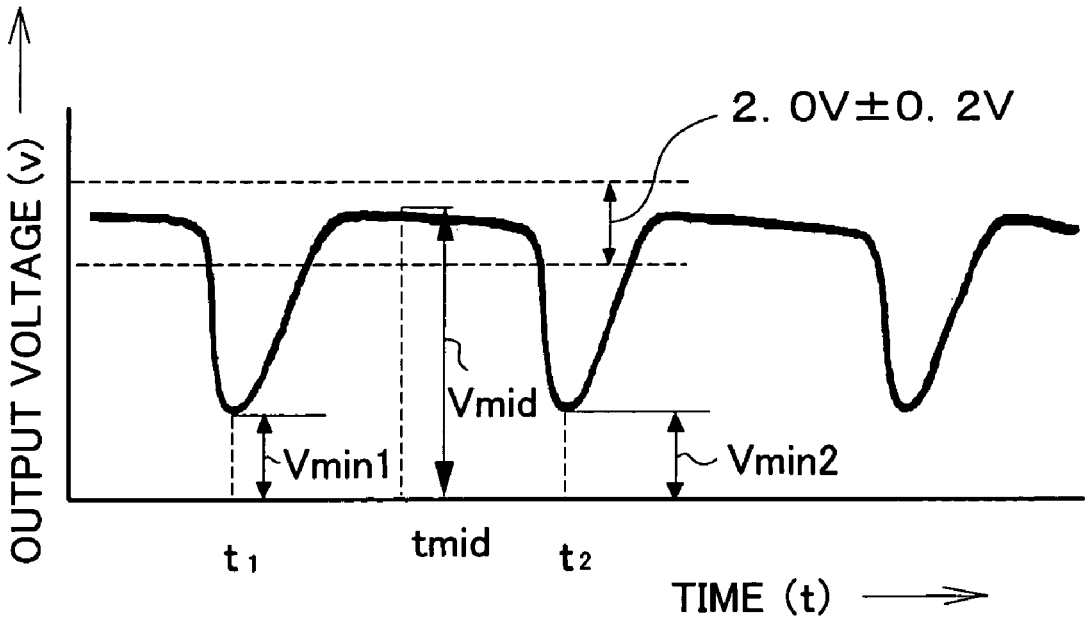
FIG. 9 is a graph showing an output waveform from the magnetic permeameter according to the second embodiment.

FIG. 8 is a flowchart for explaining a determination procedure of the toner's magnetic permeability in this laser printer 1. The procedure to the release of the toner's empty state (S. 6) is similar to that shown in FIG. 6, and a description thereof will be omitted. When the toner's empty state turns off, whether or not the toner T is a genuine product is subsequently determined based on a middle output of two adjacent low output peaks among the output values from the magnetic permeameter 15. More specifically, among the sampled output values from the magnetic permeameter 15 as shown in FIG. 9, time t1 corresponding to the minimum output value Vmin1 and time t2 corresponding to the next periodic minimum output value Vmin2 are detected (S. 11, S. 12). Next, an output voltage Vmid corresponding to time tmid=(t1+t2)/2 is calculated (S. 13), and the magnetic characteristic determination part 36 determines whether the Vmid is within the predetermined output range (S. 14). The second embodiment sets the predetermined output range to 2.0 V±0.2 V.

When the output value Vmid is within 2.0 V±0.2 V, the toner T is apparently a genuine product, and the user can use the laser printer 1 again with no message. When the output value Vmid is not within 2.0 V±0.2 V, the toner T is apparently a non-genuine product unsuitable for this laser printer 1, and the laser printer 1 indicates an alarm message "use of this toner might harm the printing quality or break down the printer" on the display 34 and the screen of the computer 35 (S. 15).

Similar to the first embodiment, the output value Vmid may be repetitively detected for ten periods of the first agitator 11. For improved accuracy of the determination of whether the toner is a genuine product, it is determined that the toner T is a genuine product when all the output values Vmid for ten samples are within 2.0 V±0.2 V, and that the toner T is a non-genuine product when one of the output values Vmid for ten samples is not within 2.0 V±0.2 V.

The second embodiment can stably detect the non-genuine toner even when the output from the magnetic permeameter 15 contains noises, varies, and thus becomes high just after the cleaner 37 cleans the sensor surface. While the second embodiment defines tmid as tmid=(t1+t2)/2, the present invention is not limited to the second embodiment and may arbitrarily set tmid as tmid=(t1+t2)/3 or tmid=(t1+t2)/4. The divisor is a coefficient properly selected according to the printer's structure and design value.

Figure 10:
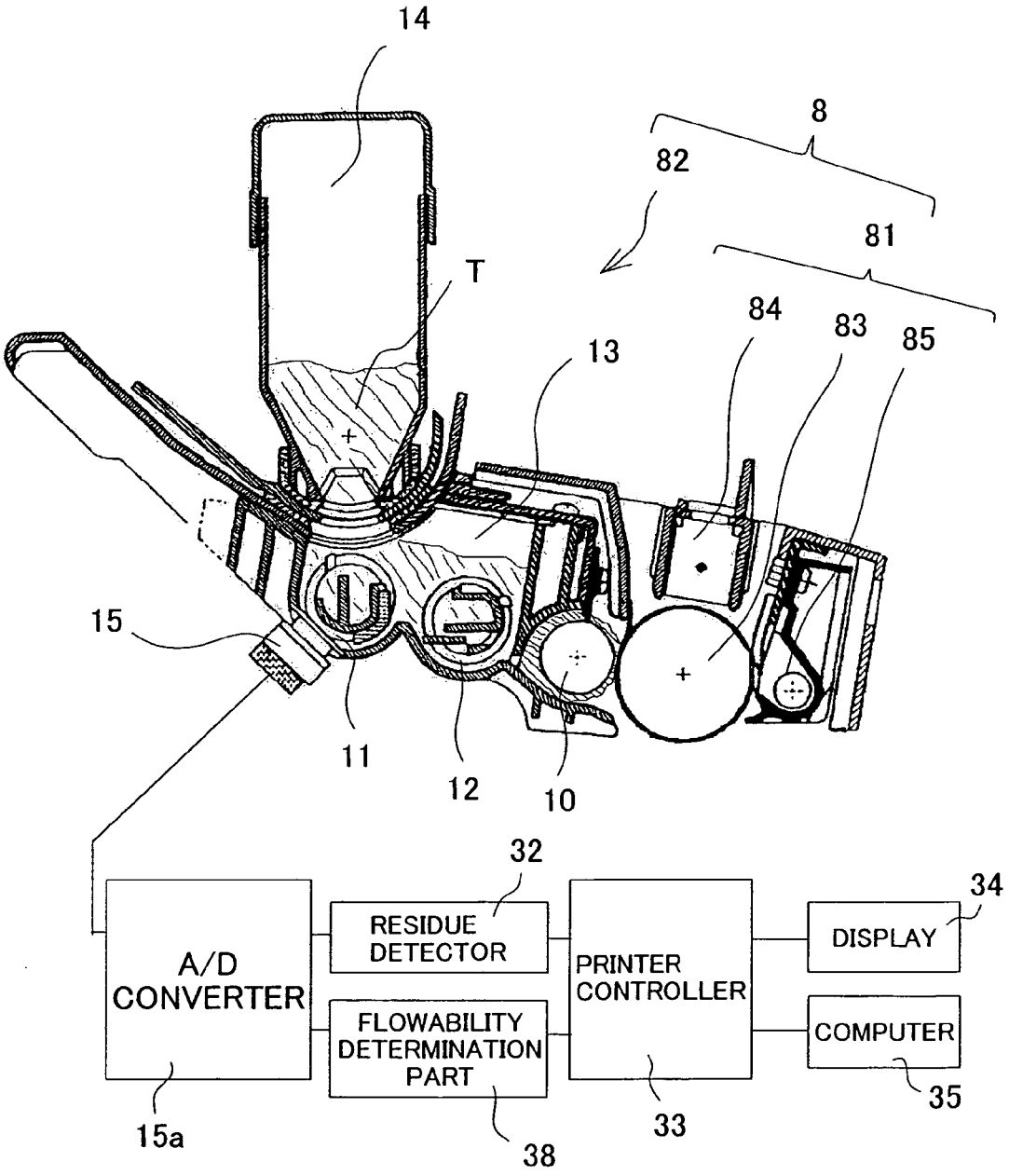
FIG. 10 is a sectional view of principal part of a print unit in a laser printer according to a third embodiment of the present invention, and a block diagram of a schematic structure of a consumable-article detecting apparatus.
Figure 11:
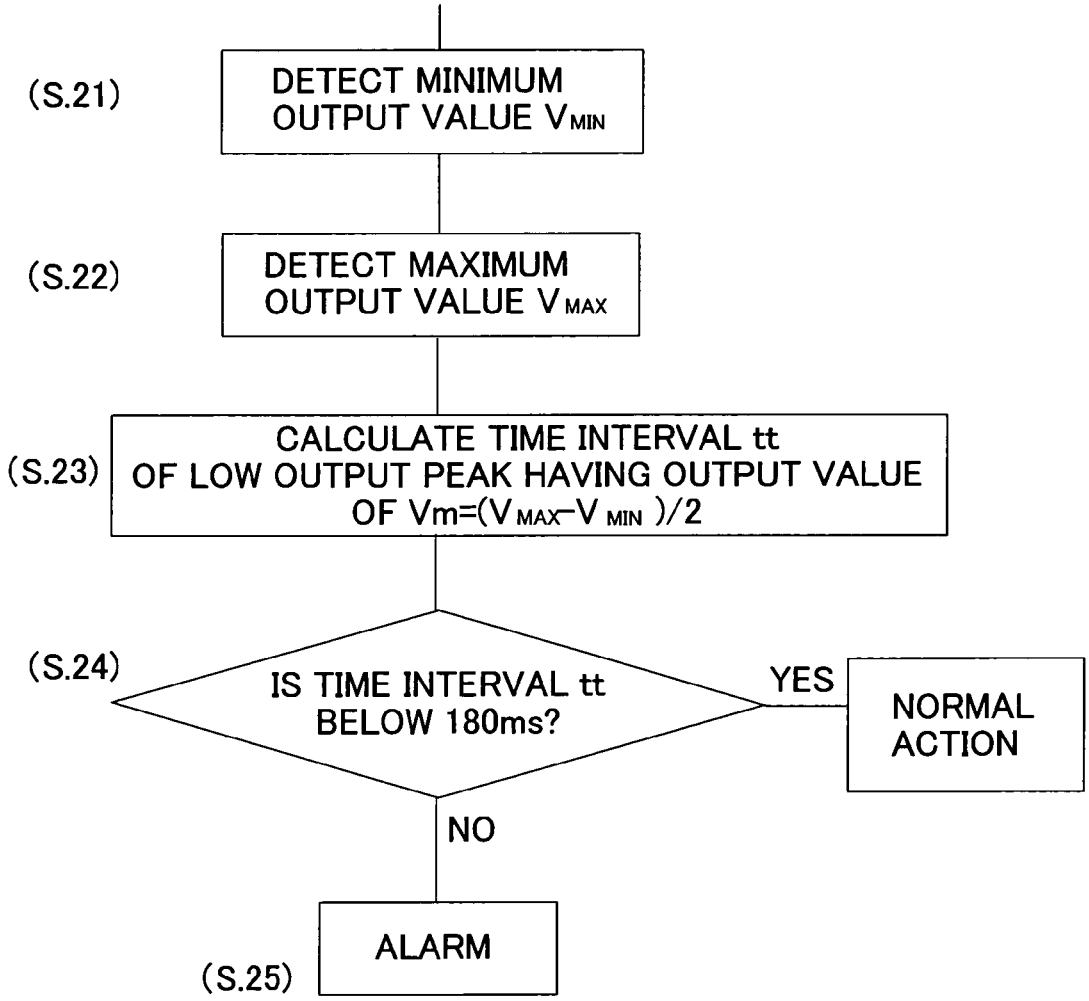
FIG. 11 is a flowchart for explaining a determination procedure of the toner's flowability in the laser printer according to the third embodiment.

A description will now be given of a consumable-article detecting apparatus according to a third embodiment of the present invention. FIG. 10 is a block diagram showing a structure of principal part of the print unit 8 according to the third embodiment. Those elements which are corresponding elements in the first embodiment are designated by the same reference numerals, and a description thereof will be omitted. The third embodiment configures a flowability determination part 38 to determine the flowability of the toner T, based on an output from the magnetic permeameter 15. Referring now to FIG. 11, a description will be given of a concrete determination procedure. The procedure to the release of the toner's empty state (S. 6) is similar to that shown in FIG. 6, and a description thereof will be omitted. When the toner's empty state turns off, whether or not the toner T is a genuine product is subsequently determined based on a time interval of a low output peak having a predetermined output value among the output values from the magnetic permeameter 15.

Figure 12:
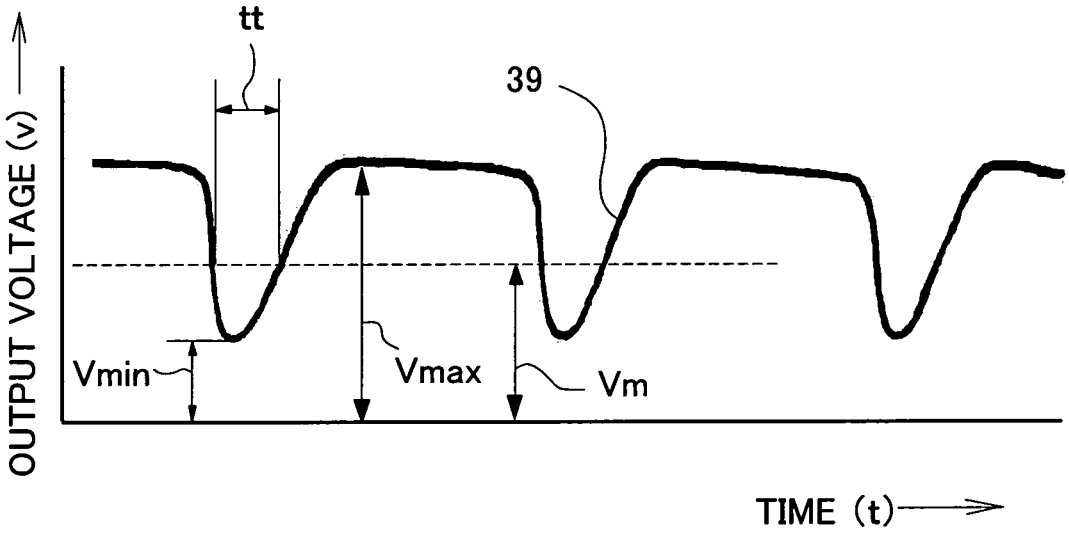
FIG. 12 is a graph showing an output waveform from the magnetic permeameter according to the third embodiment.

A time period from when the cleaner 37 cleans the sensor surface and the output value exhibits a low output peak value, to when the output value becomes high corresponds to the flowability of the toner T. An inclination of a portion 39 in a graph of FIG. 12 from the low output peak to the high output peak is sharp with toner having good flowability, whereas an inclination of the portion 39 from the low output peak to the high output peak is moderate with toner having bad flowability. Thus, whether or not the toner T is a genuine product is determined based on the inclination of the portion 39.

The magnetic permeameter 15 detects the minimum output value Vmin and the maximum output value Vmax (S. 21, S. 22). Next, the flowability determination part 38 calculates a half value Vm of an output difference between the maximum output value Vmax and the minimum output value Vmin, (i.e., Vmax−Vmin) and calculates a time interval tt of the low output peak having the output value Vm, which corresponds to a time period from when the output value becomes lower than Vm to when the output value becomes higher than Vm again (S. 23).

The time interval is an index value indicative of the flowability of the toner T, and the flowability determination part 38 determines whether the time interval tt is within a predetermined range (S. 24). The third embodiment determines that the toner T is a genuine product when the time interval tt is smaller than 180 ms, and allows the user to use the laser printer 1 again with no message. When the time interval tt is greater than 180 ms, this embodiment determines that the toner T is a non-genuine product unsuitable for this laser printer 1, and the laser printer 1 indicates an alarm message "use of this toner might harm the printing quality or break down the printer" on the display 34 and the screen of the computer 35 (S. 25).

Similar to the first embodiment, the time interval tt may be repetitively calculated for ten periods of the first agitator 11. In order to improve the accuracy of the determination of whether the toner is a genuine product, it is determined that the toner T is a genuine product when seven or more out of ten sampled time intervals tt are smaller than 180 ms, and that the toner T is a non-genuine product when six or fewer are smaller than 180 ms.

While the third embodiment defines Vm as Vm=(Vmax−Vmin)/2, the present invention is not limited to the third embodiment and may arbitrarily set Vm as Vm=(Vmax−Vmin)/3 or Vm=(Vmax−Vmin)/4. The divisor is a coefficient properly selected according to the printer's structure and design value.

A description will now be given of a consumable-article detecting apparatus according to a fourth embodiment of the present invention. The fourth embodiment is different from the third embodiment in the determination procedure of the toner T's flowability by the flowability determination part 38, but other than that the fourth embodiment is similar to the third embodiment and a description thereof will be omitted.

Figure 13:
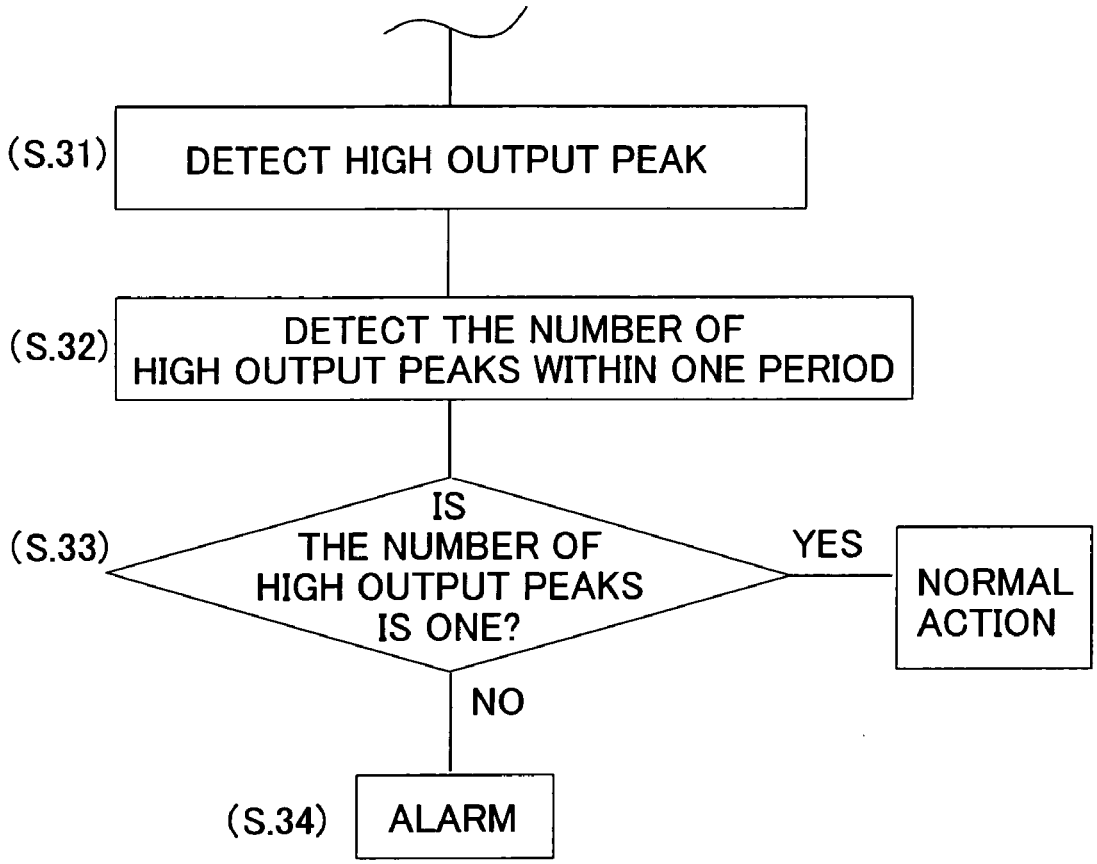
FIG. 13 is a flowchart for explaining a determination procedure of the toner's flowability in the laser printer according to a fourth embodiment.

FIG. 13 is a flowchart for explaining a determination procedure of the toner's flowability in this laser printer 1. The procedure to the release of the toner's empty state (S. 6) is similar to that shown in FIG. 6, and a description thereof will be omitted. When the toner's empty state turns off, whether or not the toner T is a genuine product is subsequently determined based on a disturbance level of an output value from the magnetic permeameter 15.

Figure 14A:
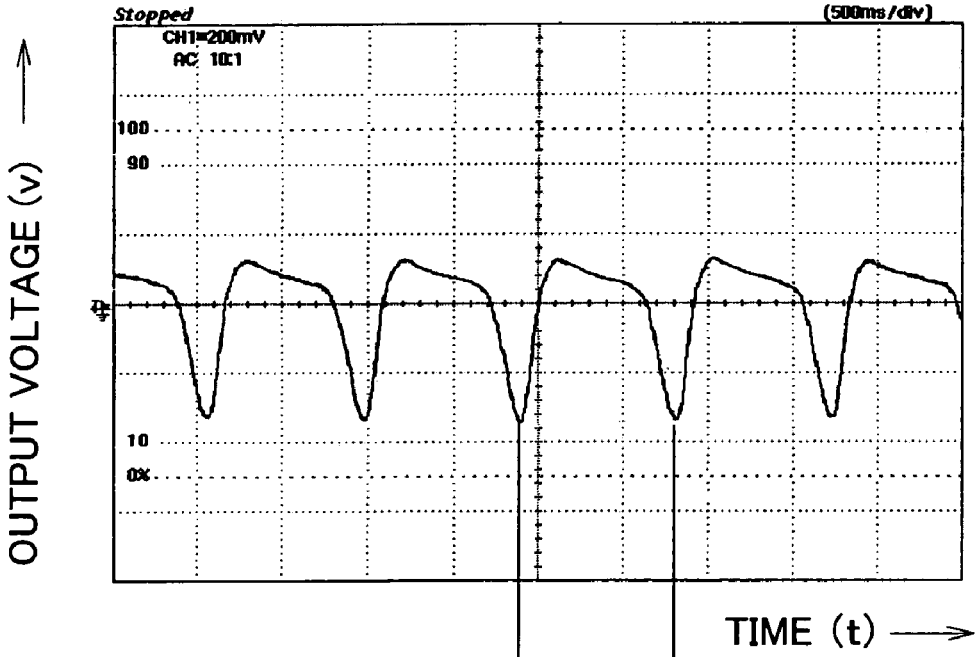
Figure 14B:
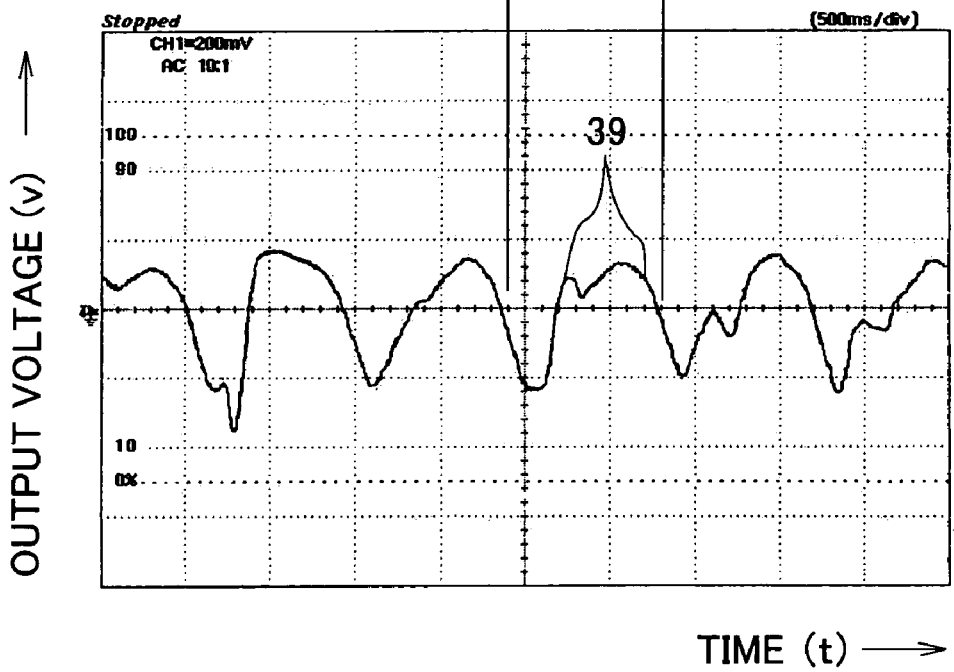

Since a cleaning period of the sensor surface by the cleaner 37 is previously known form a rotational period of the first agitator 11, a period of the output waveform of the magnetic permeameter 15 is previously known. Since the number of rotations of the first agitator 11 is 65.5 rpm in the fourth embodiment, the magnetic permeameter 15 has a period of the output waveform of 916 ms. When the toner T has good flowability, the magnetic permeameter 15 has a regularly ordered output waveform with one high output peak and one low output peak within one period as shown in FIG. 14A. However, when the toner T has bad flowability, the output waveform disturbs as shown in FIG. 14B and has plural high output peaks 39 within one period.

Thus, whether or not the toner T is a genuine product can be determined (S. 33) by detecting the high output peak 39 from the magnetic permeameter 15 (S. 31) and by detecting the number of high output peaks within one period (S. 32). It is determined that the toner T is a genuine product when the number of high output peaks 39 is one within one period, and the user can use the laser printer 1 again with no message. When the number of high output peaks 39 within one period is not one, it is determined that the toner T is a non-genuine product unsuitable for this laser printer 1, and the laser printer 1 indicates an alarm message "use of this toner might harm the printing quality or break down the printer" on the display 34 and the screen of the computer 35 (S. 34).

Figure 15:
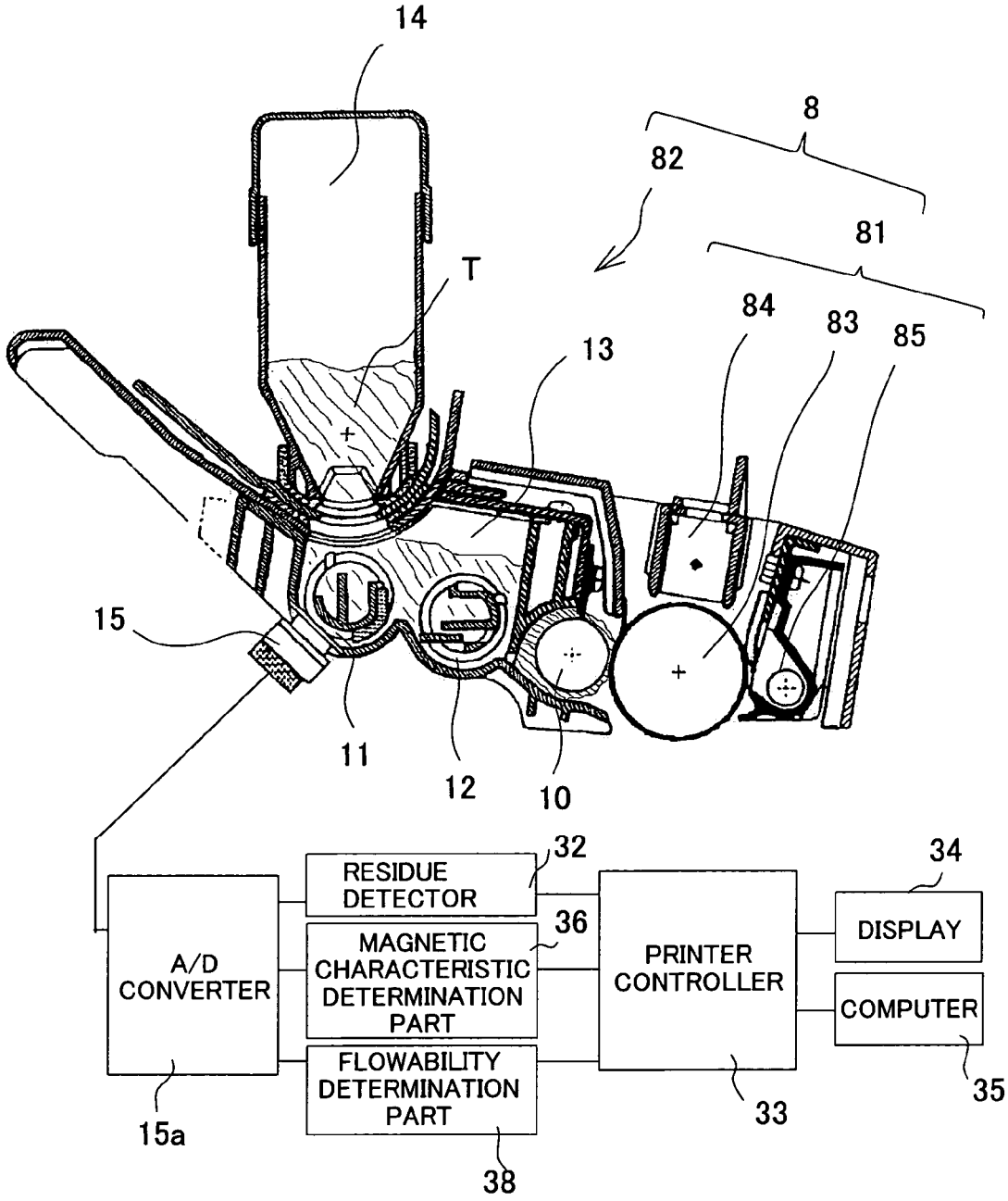
FIG. 15 is a sectional view of principal part of a print unit in a laser printer according to a fifth embodiment of the present invention, and a block diagram of a schematic structure of a consumable-article detecting apparatus.
Figure 16:
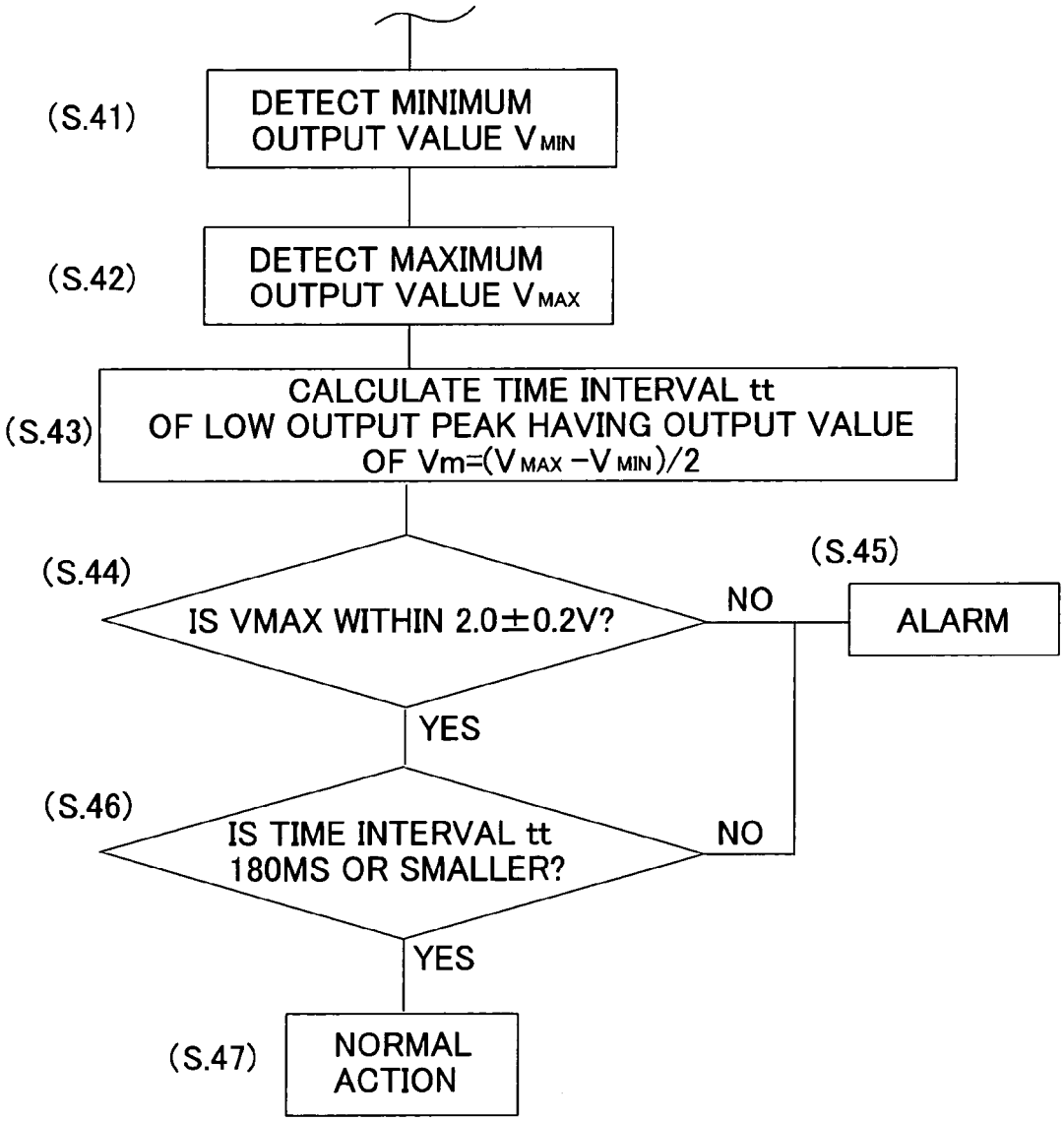
FIG. 16 is a flowchart for explaining a determination procedure of the toner's flowability in the laser printer according to the fifth embodiment.

A description will now be given of a consumable-article detecting apparatus according to a fifth embodiment of the present invention. FIG. 15 is a block diagram showing a structure of principal part of the print unit 8 according to the fifth embodiment. Those elements which are corresponding elements in the first embodiment are designated by the same reference numerals, and a description thereof will be omitted. The fifth embodiment configures the magnetic characteristic determination part 36 to determine the magnetic permeability of the toner T and the flowability determination part 38 to determine the flowability of the toner T, based on an output from the magnetic permeameter 15. Referring now to FIG. 16, a description will be given of a concrete determination procedure. The procedure to the release of the toner's empty state (S. 6) is similar to that shown in FIG. 6, and a description thereof will be omitted. When the toner's empty state is released, the magnetic characteristic determination part 36 and the flowability determination part 38 subsequently determine, based on the output value from the magnetic permeameter 15, whether or not the toner T is a genuine product.

The magnetic permeameter 15 detects the minimum output value Vmin and the maximum output value Vmax (S. 41 and S. 42). Next, the flowability determination part 38 calculates a half value Vm of the output difference between the maximum output value Vmax and the minimum output value Vmin (i.e., Vmax−Vmin), and calculates the time interval tt of the low output peak having the output value Vm, which corresponds to a time period from when the output value becomes lower than Vm to when the output value becomes higher than Vm again (S. 43). The magnetic characteristic determination part 36 determines whether the maximum output value Vmax is within a predetermined range, such as 2.0 V±0.2 V (S. 44). When the maximum output value Vmax is not within the predetermined range, it is determined that the toner T is a non-genuine product, and the laser printer 1 indicates an alarm message on the display 34 and the screen of the computer 35 (S. 45). Similar to the first embodiment, the magnetic characteristic determination part 36 determines for samples of ten periods, and determines that the toner T is a non-genuine product when any one of them is outside the predetermined range.

When the maximum output value Vmax is within the predetermined range, the flowability determination part 38 whether or not the time interval tt is within a predetermined range, such as 180 ms (S. 46). When the time interval tt is not within a predetermined range, it is determined that the toner T is a non-genuine product and the laser printer 1 indicates an alarm message on the display 34 and the screen of the computer 35 (S. 45). When the time interval tt is within the predetermined range, it is determined that the toner T is a genuine product (S. 47). Similar to the third embodiment, the flowability determination part 38 determines for samples of ten periods, and determines that the toner T is a genuine product when the time interval is within the predetermined range seven or more times.

Further, the present invention is not limited to these preferred embodiments, and various variations and modifications may be made without departing from the scope of the present invention.

The inventive consumable-article detecting apparatus can prevent various malfunctions due to use of an unsuitable consumable article, such as lowered printing quality and faults, such as toner adhesions and paper jam.

What is claimed is:

1. A consumable-article detecting apparatus used to inform an operator that consumable article is unsuitable for an image forming apparatus, said consumable-article detecting apparatus comprising:

a magnetic permeameter that detects a physical property value of a consumable article used for the image forming apparatus, the physical property value including at least one of a magnetic permeability and flowability; and a determination part that determines, based on an output of a peak portion from magnetic permeameter, whether or not the physical property value of the consumable article is within a permissible range.

2. A consumable-article detecting apparatus according to claim 1, wherein said determination part determines based on a value of a high output peak from the magnetic permeameter.

3. A consumable-article detecting apparatus according to claim 1, wherein said determination part determines based on a value of a midpoint between two adjacent low output peaks from the magnetic permeameter.

4. A consumable-article detecting apparatus according to claim 1, wherein said determination part determines that the physical property value is within the permissible range when a time interval of a low output peak having a predetermined output value from the magnetic permeameter is below a preset value.

5. A consumable-article detecting apparatus according to claim 1, wherein said determination part informs, when:

determining that the physical property value is not within the permissible range, an operator that the consumable article is unsuitable for the image forming apparatus.

6. A consumable-article detecting apparatus, according to claim 5, wherein said determination part uses an alarm of a possible fault.

7. An image forming apparatus comprising:

a medium supply part that supplies a recording medium;

a printing unit that forms a toner image;

a medium ejecting part that ejects the recording medium on which the image was formed; and a consumable-article detecting apparatus according to claim 1.

* * * * *